US010190390B2

(12) United States Patent
Mailand et al.

(10) Patent No.: US 10,190,390 B2
(45) Date of Patent: Jan. 29, 2019

(54) PRESSURE ACTUATED PORTED SUB FOR SUBTERRANEAN CEMENT COMPLETIONS

(71) Applicant: Baker Hughes, A GE COMPANY, LLC, Houston, TX (US)

(72) Inventors: Jason C. Mailand, The Woodlands, TX (US); Justin C. Kellner, Pearland, TX (US); James S. Sanchez, Tomball, TX (US); Paul Madero, Edmond, OK (US); Charles C. Johnson, League City, TX (US); Robert W. Putch, Cypress, TX (US)

(73) Assignee: BAKER HUGHES, A GE COMPANY, LLC

( * ) Notice: Subject to any disclaimer, the term of this patent is extended or adjusted under 35 U.S.C. 154(b) by 500 days.

(21) Appl. No.: 14/819,074

(22) Filed: Aug. 5, 2015

(65) Prior Publication Data

US 2015/0337625 A1 Nov. 26, 2015

Related U.S. Application Data

(62) Division of application No. 13/651,878, filed on Oct. 15, 2012, now Pat. No. 9,359,865.

(51) Int. Cl.
*E21B 23/00* (2006.01)
*E21B 34/10* (2006.01)
(Continued)

(52) U.S. Cl.
CPC ..... *E21B 34/10* (2013.01); *E21B 23/006* (2013.01); *E21B 34/102* (2013.01); *E21B 34/14* (2013.01); *E21B 2034/007* (2013.01)

(58) Field of Classification Search
CPC ..... E21B 34/10; E21B 34/14; E21B 34/063; E21B 34/102; E21B 23/006; E21B 33/12
See application file for complete search history.

(56) References Cited

U.S. PATENT DOCUMENTS 3,189,044 A 6/1965 Sizer
3,442,328 A 5/1969 Nutter
(Continued)

FOREIGN PATENT DOCUMENTS

WO 2012115868 A2 8/2012
WO 2012145735 A1 10/2012

OTHER PUBLICATIONS

Delta Stim Initiator Valve Drawing, HAL24633, Date Unknown, 1 page.

(Continued)

*Primary Examiner* — Brad Harcourt
*Assistant Examiner* — David Carroll
(74) *Attorney, Agent, or Firm* — Shawn Hunter

(57) ABSTRACT

A shifting sleeve has differential piston areas so that applied pressure displaces the sleeve against spring bias, which preferably is a series of Belleville washer stacks associated with modular mandrel components, to obtain the desired opposing force to the movement initiated with pressure applied to differential piston areas. An indexing feature is located between the sleeve and the mandrel passage wall and on a predetermined number of cycles disables the Belleville washer stacks from biasing the sleeve in an opposed direction as when pressure is applied. At this time the pressure in the mandrel acting on the differential piston area simply shifts the sleeve to open a lateral port so that fracturing through the cement that was earlier placed with the port closed can take place.

13 Claims, 7 Drawing Sheets

(51) Int. Cl.
*E21B 34/14* (2006.01)
*E21B 34/00* (2006.01)

(56) References Cited

U.S. PATENT DOCUMENTS

| | | | | |
|---|---|---|---|---|
| 3,662,834 | A | 5/1972 | Young | |
| 3,930,540 | A | 1/1976 | Holden et al. | |
| 3,964,544 | A | 6/1976 | Farley | |
| 3,986,554 | A | 10/1976 | Nutter | |
| 4,109,724 | A | 8/1978 | Barrington | |
| 4,257,484 | A | 3/1981 | Whitley et al. | |
| 4,330,039 | A | 5/1982 | Vann et al. | |
| 4,403,659 | A | 9/1983 | Upchurch | |
| 4,434,854 | A | 3/1984 | Vann et al. | |
| 4,691,779 | A | 9/1987 | McMahan et al. | |
| 4,718,494 | A | 1/1988 | Meek | |
| 4,907,655 | A | 3/1990 | Hromas | |
| 4,979,569 | A | 12/1990 | Anyan et al. | |
| 4,991,654 | A | 2/1991 | Brandell et al. | |
| 5,044,444 | A | 9/1991 | Coronado | |
| 5,095,988 | A * | 3/1992 | Bode | E21B 21/10 137/268 |
| 5,308,783 | A | 5/1994 | Krautschneider et al. | |
| 5,325,917 | A | 7/1994 | Szarka | |
| 5,355,959 | A | 10/1994 | Walter et al. | |
| 5,649,597 | A | 7/1997 | Ringgenberg | |
| 5,810,087 | A | 9/1998 | Patel | |
| 5,819,853 | A | 10/1998 | Patel | |
| 5,950,733 | A | 9/1999 | Patel | |
| 5,954,135 | A | 9/1999 | Williamson et al. | |
| 6,186,227 | B1 | 2/2001 | Vaynshteyn et al. | |
| 6,286,594 | B1 | 9/2001 | French | |
| 6,293,346 | B1 | 9/2001 | Patel | |
| 6,386,289 | B1 | 5/2002 | Patel | |
| 6,550,541 | B2 | 4/2003 | Patel | |
| 6,604,582 | B2 | 8/2003 | Flowers et al. | |
| 6,659,186 | B2 | 12/2003 | Patel | |
| 6,684,950 | B2 | 2/2004 | Patel | |
| 6,722,439 | B2 | 4/2004 | Garay et al. | |
| 6,945,331 | B2 | 9/2005 | Patel | |
| 6,948,561 | B2 | 9/2005 | Myron | |
| 7,562,713 | B2 | 7/2009 | Basmajian et al. | |
| 7,640,988 | B2 | 1/2010 | Phi et al. | |
| 7,703,510 | B2 | 4/2010 | Xu | |
| 7,762,324 | B2 | 7/2010 | Clem | |
| 7,841,412 | B2 | 11/2010 | Jasser et al. | |
| 7,845,416 | B2 | 12/2010 | Turner et al. | |
| 7,909,095 | B2 | 3/2011 | Richards et al. | |
| 7,913,770 | B2 | 3/2011 | Schramm et al. | |
| 8,171,994 | B2 | 5/2012 | Murray et al. | |
| 8,276,670 | B2 | 10/2012 | Patel | |
| 2006/0237187 | A1* | 10/2006 | Stoesz | E21B 31/005 166/177.6 |
| 2008/0066923 | A1 | 3/2008 | Xu | |
| 2009/0014168 | A1* | 1/2009 | Tips | E21B 33/14 166/73 |
| 2010/0236781 | A1 | 9/2010 | Mytopher et al. | |
| 2011/0011597 | A1* | 1/2011 | Fay | E21B 23/006 166/373 |
| 2011/0056679 | A1 | 3/2011 | Rytlewski | |
| 2011/0100643 | A1 | 5/2011 | Themig et al. | |
| 2011/0108272 | A1* | 5/2011 | Watson | E21B 34/103 166/271 |
| 2011/0114324 | A1 | 5/2011 | Hayter et al. | |
| 2011/0278017 | A1 | 11/2011 | Themig et al. | |
| 2012/0006553 | A1 | 1/2012 | Korkmaz | |
| 2012/0048559 | A1 | 3/2012 | Ganguly et al. | |
| 2012/0186803 | A1 | 7/2012 | Xu et al. | |
| 2012/0211242 | A1 | 8/2012 | Patel | |
| 2012/0267119 | A1 | 10/2012 | Patel | |
| 2012/0285702 | A1 | 11/2012 | Rytlewski | |

OTHER PUBLICATIONS

Schlumberger, Kickstary Rupture Disc Valve, Date Unknown, 1 page.

* cited by examiner

PRESSURE ACTUATED PORTED SUB FOR SUBTERRANEAN CEMENT COMPLETIONS

PRIORITY INFORMATION

This application is a divisional of U.S. patent application Ser. No. 13/651,878 filed on Oct. 15, 2012.

FIELD OF THE INVENTION

The field of the invention is a pressure actuated sleeve used in a cementing assembly that is responsive to tubing pressure to open a port and more particularly a sleeve that has differential piston areas where application and removal of pressure cycles the sleeve on a j-slot to allow string pressure testing at a higher pressure than a pressure that releases a bias on the sleeve to allow the differential piston area to shift the sleeve to open a port at a lower pressure than the string integrity testing pressure.

BACKGROUND OF THE INVENTION

Prior sleeves that have been deployed in cementing service have been based on the concept of providing opposed piston areas exposed to tubing pressure that are of different dimensions so that raising the tubing pressure will create a sufficient net force to in theory overcome seal friction and move the sleeve to the open position. One such design is the Halliburton Initiator Sliding Sleeve that has a larger upper seal diameter than a lower seal. Raising tubing pressure creates a net differential force and the piston is allowed to move because there is an atmospheric chamber between the upper and lower seals. The problem is that to get the lower seal to be smaller than the upper seal to create the desired net force in the needed direction, the wall of the sleeve adjacent the lower seal and the atmospheric chamber has to be reduced so that the sleeve can shift while the volume of the atmospheric chamber is reduced.

The wall of the sleeve in the area of the atmospheric chamber sees substantial differential pressure and can flex or bend. When that happens the sleeve gets stuck and the desired port opening in the housing fails to occur.

Apart from these designs there are sleeves that respond to tubing pressure with an associated piston that is open on one side to tubing pressure and on the other side to annulus pressure. Such a design is illustrated in US Publication 2011/0100643. This design cannot be used in cementing applications as the filling up of the annulus with cement can block access to annulus pressure. Furthermore, there is a leak path potential from the tubing to the annulus through a piston seal leak.

Various pressure operated sleeves for downhole use are shown in USP and Publications: U.S. Pat. Nos. 7,703,510; 3,662,834; 4,330,039; 6,659,186; 6,550,541; 5,355,959; 4,718,494; 7,640,988; 6,386,289; US 2010/0236781 A1; U.S. Pat. Nos. 5,649,597; 5,044,444; 5,810,087; 5,950,733; 5,954,135; 6,286,594; 4,434,854; 3,189,044; 6,948,561; US Publication 20120006553; U.S. Pat. No. 8,171,994; US Publication 2011/0114324; US Publication 2012/0186803; U.S. Pat. Nos. 4,991,654; 5,325,917; US Publication 2012/0048559; US Publication 2011/0278017; U.S. Pat. Nos. 6,308,783 and 6,722,439.

More noteworthy with respect to the present invention is Jasser U.S. Pat. No. 7,841,412 that couples a sleeve with a flapper at the top that closes with pressure delivered from above the closed flapper to then cycle the sleeve using a j-slot so that ultimately a lateral port is opened or closed. The application is to prevent fluid loss during treatment and the design is impractical in a cementing application.

What is needed and provided by the present invention is an actuation technique for a sliding sleeve to open a port that responds to tubing pressure but addresses the flexing or bending problem associated with prior designs so that reliable movement of the sleeve is obtained. In the preferred embodiment the sleeve has differential piston areas so that applied pressure displaces the sleeve against spring bias which preferably is a series of Belleville washer stacks associated with modular mandrel components to obtain the desired opposing force to the movement initiated with pressure applied to differential piston areas. An indexing feature is located between the sleeve and the mandrel passage wall and on a predetermined number of cycles disables the Belleville washer stacks from biasing the sleeve in an opposed direction as when pressure is applied. At this time the pressure in the mandrel acting on the differential piston area simply shifts the sleeve to open a lateral port so that fracturing through the cement that was earlier placed with the port closed can take place.

Those skilled in the art will better appreciate more aspects of the invention from a review of the description of the preferred embodiment and the associated drawings while recognizing that the full scope of the invention is to be determined by the appended claims.

SUMMARY OF THE INVENTION

A shifting sleeve has differential piston areas so that applied pressure displaces the sleeve against spring bias, which preferably is a series of Belleville washer stacks associated with modular mandrel components, to obtain the desired opposing force to the movement initiated with pressure applied to differential piston areas. An indexing feature is located between the sleeve and the mandrel passage wall and on a predetermined number of cycles disables the Belleville washer stacks from biasing the sleeve in an opposed direction as when pressure is applied. At this time the pressure in the mandrel acting on the differential piston area simply shifts the sleeve to open a lateral port so that fracturing through the cement that was earlier placed with the port closed can take place.

DETAILED DESCRIPTION OF THE PREFERRED EMBODIMENT

Figure 1:
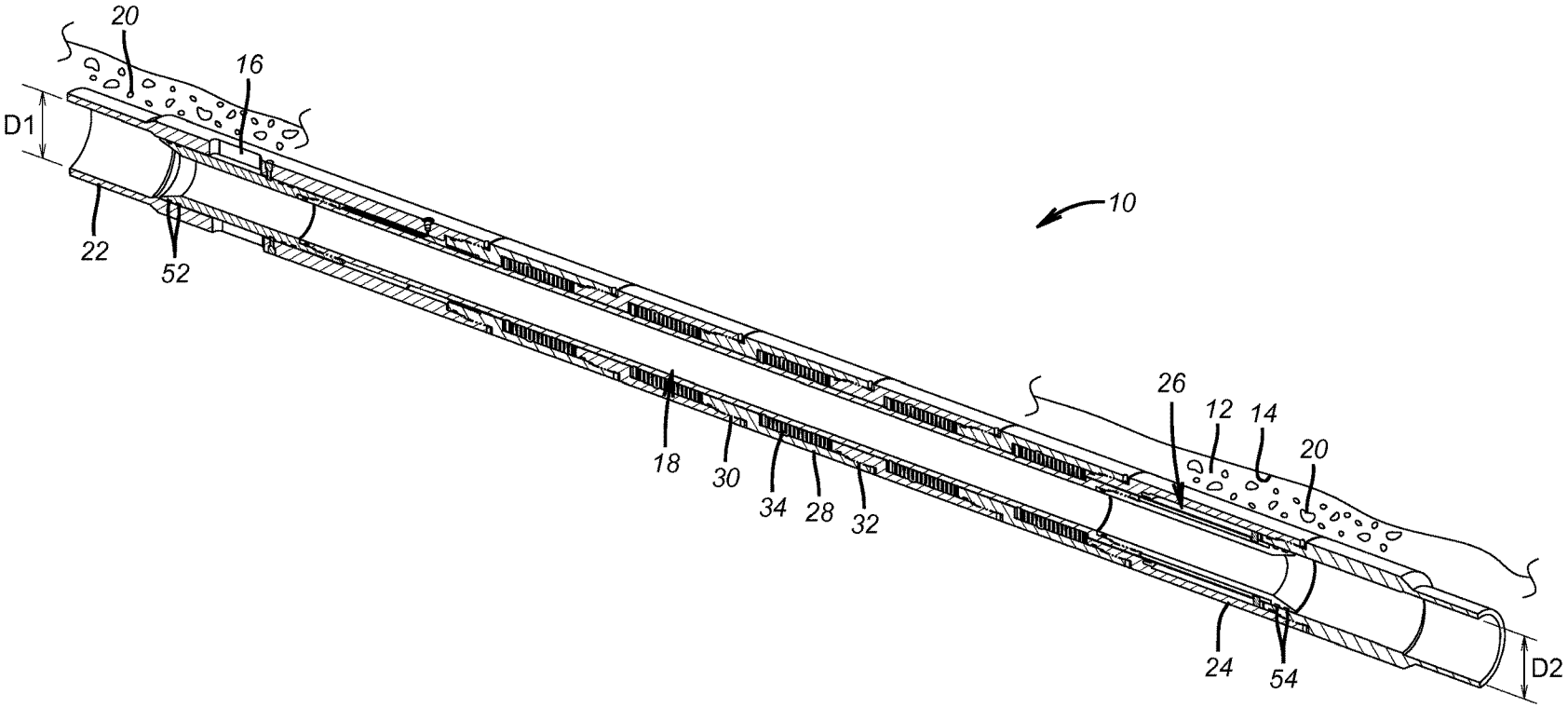
FIG. 1 is a perspective view of the ported sub shown in the run in position.

Referring to FIG. 1 the ported sub 10 is part of a cementing assembly supported on a string that is not shown and leading to a bottom hole assembly (BHA) that has a cementing shoe and landing collars for wiper darts that aid in displacing cement to the surrounding annulus 12 of a borehole 14. When the cementing is done the port or ports 16 can be opened with shifting of sleeve assembly 18 so that the formation can be fractured through the set up cement.

The sub 10 allows pressure testing the string supporting the sub 10 at a higher pressure than will ultimately be needed to open the ports 16 for a subsequent frac of the formation through the cement 20.

Figure 8:
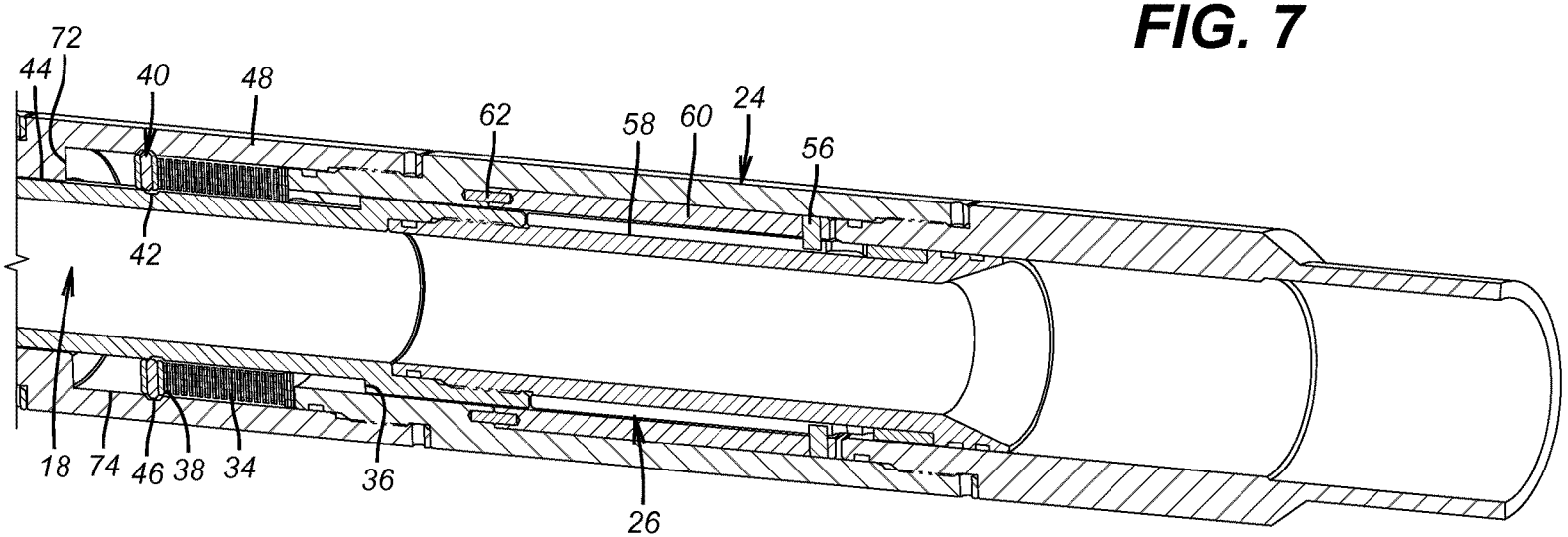
FIG. 8 shows the spring retainer moved into a recess to disengage the spring assembly from biasing the sleeve.

The ported sub 10 has a top sub 22 and a bottom sub 24. Each of these subs can be in one or more parts secured together generally by being threaded together. The top sub 22 has the ports 16 and the bottom sub 24 houses the indexing assembly 26 as will be explained in more detail below. In between the subs 22 and 24 are one or more modules 28 that have threaded ends 30 and 32 so that one or more modules can be stacked. FIG. 1 happens to show five modules 28 but fewer or more can be used depending on the desired force to push the sleeve assembly 18 in an uphole direction, which is toward the left end of FIG. 1. The modules can be identical or different and are each preferably equipped with a stack of Belleville washers as also seen better in FIG. 6. FIG. 8 shows a lowermost module 28 that is adjacent the bottom sub 24. Each module 18 has a shoulder 36 on which the stack 34 bears for pushing the sleeve assembly 18 to the left in an uphole direction. The opposite end 38 of each stack 34 is retained to the sleeve assembly 18 with an end ring assembly 40 that comprises one or more dogs between two rings that extends into a groove 42 in the outer wall 44 of the sleeve assembly 18. Release groove 46 is in the body 48 of the module 28. Movement of the sleeve assembly 18 to the right or downhole takes with it end ring 40 and compresses the stack 34. Movement in that direction is stopped short of end ring 40 reaching release groove 46 by the indexing assembly 26 as will be described below. Once end ring 40 gets into groove 46 it is liberated from being in registry with groove 42. As long as end ring 40 is in groove 42 movement of the sleeve assembly 18 will compress the stack 34. Note that a stack of Belleville washers is preferred because it can deliver a large force after being compressed a relatively short distance and can apply that force constantly when the movement direction of the sleeve assembly 18 is reversed as the applied pressure from the surface is cut off. Other types of biasing devices are contemplated such as other types of springs or a variable volume with a compressible gas trapped inside, for example.

Figure 2:
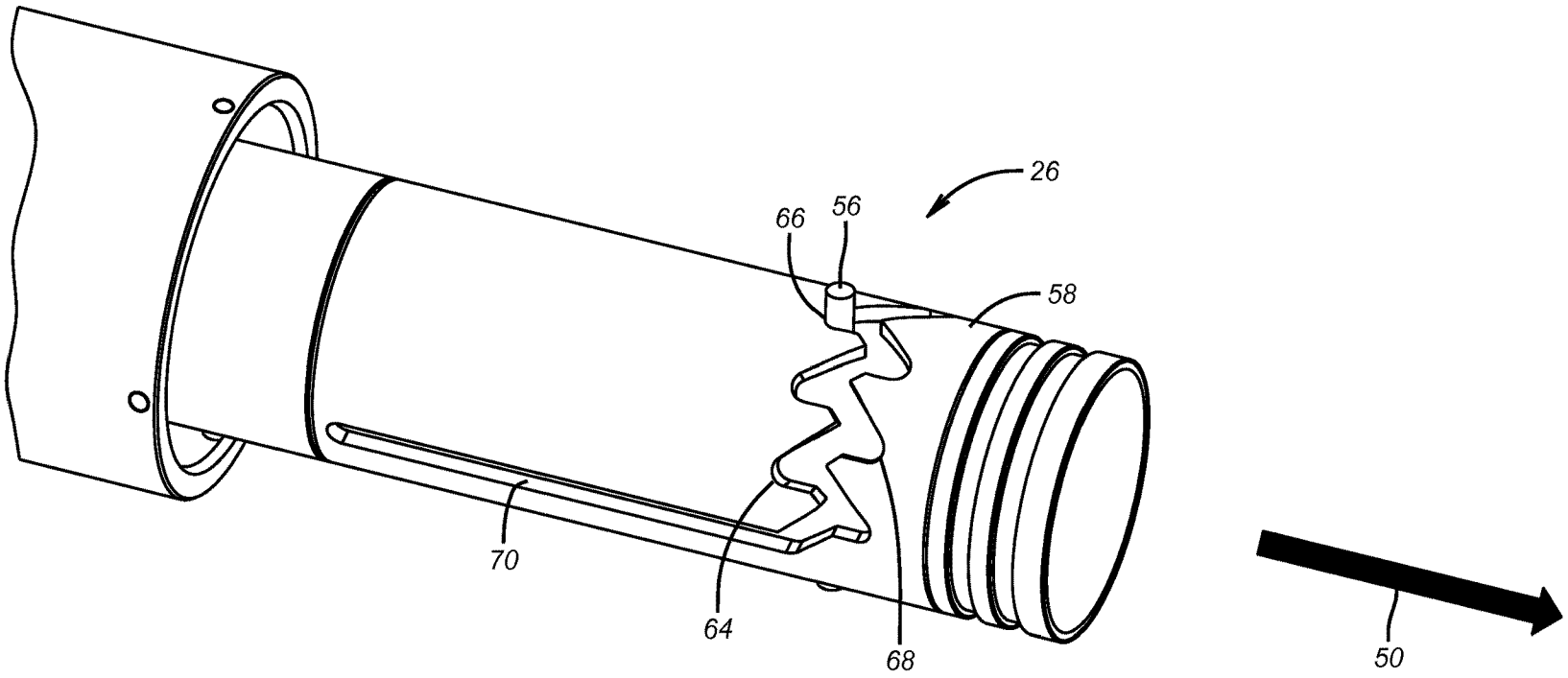
FIG. 2 is a view of the indexing mechanism under applied pressure that pushes the sliding sleeve to a point where the pin engages in the j-slot to stop the movement.

Referring again to FIG. 1 it can be seen that diameter D1 is larger than diameter D2 so that when pressure is applied to the sleeve assembly 18 there is a net unbalanced force toward the downhole direction illustrated by arrow 50 in FIG. 2. This is because the piston area defined by seal pairs 52 is larger than the piston area defined by seal pairs 54. FIG. 2 shows how the travel limit with pressure from uphole is defined using the indexing assembly 26 with the bottom sub 24 removed for clarity. The indexing pin 56 extends from fixed sleeve 60 held in the bottom sub 24. Sleeve 60 in turn surrounds sleeve 58, as best seen in FIG. 8. Sleeve 58 reciprocates with sleeve assembly 18 and turns on its own axis as the j-slot pattern 64 is encountered by the pin 56. Sleeve 60 is pinned at 62 to the bottom sub 24 to prevent rotation. Those skilled in the art will appreciate that there are a plurality of short slots 66 and 68 that are adjacent each other and represent movement of the sleeve assembly 18 against the stack 34 and upon removal of applied pressure a reverse movement of the sleeve assembly 18 under the force of the stack 34 in each module 28. FIG. 2 shows the downward travel limit of the sleeve assembly 18 under a net force from applied pressure from uphole operating on the differing piston areas represented by diameters D1 that is larger than D2. That travel limit happens when movement of the sleeve assembly 18 takes sleeve 58 down to a point where the slot depth at 66 engages the fixed pin 56. The downward travel limit shown in FIG. 2 happens each cycle until the long slot 70 comes into alignment with pin 56.

Figure 3:
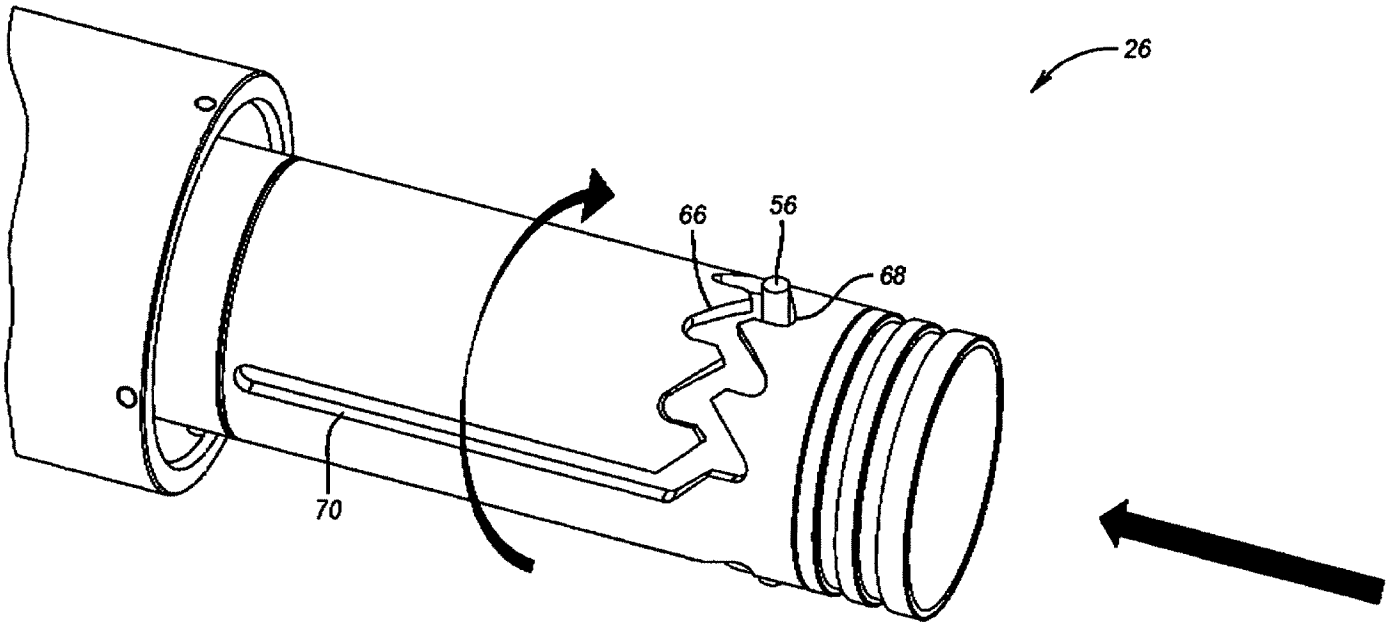
FIG. 3 shows the removal of applied pressure and the springs returning the sleeve to a point short of the slot hitting the pin.
Figure 6:
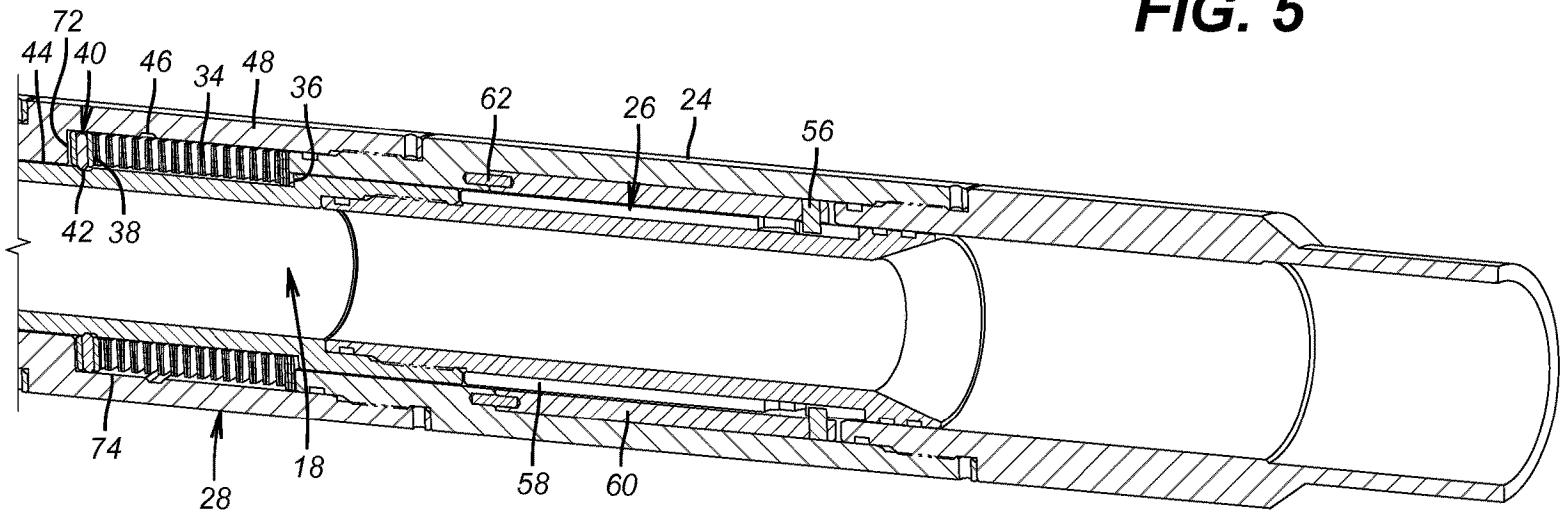
FIG. 6 shows the travel stop when applied pressure is removed and the port is still covered by the sleeve.

On the other hand when the stacks 34 push the sleeve assembly 18 in the uphole direction as shown in FIG. 3 the short slot 68 is not brought forcibly against the stationary pin 56 to avoid overstress of the pin 56. Instead the uphole movement under the bias of the stacks 34 comes to a stop when end ring 40 hits shoulder 72 in each module 28 as shown in FIG. 6.

Figure 4:
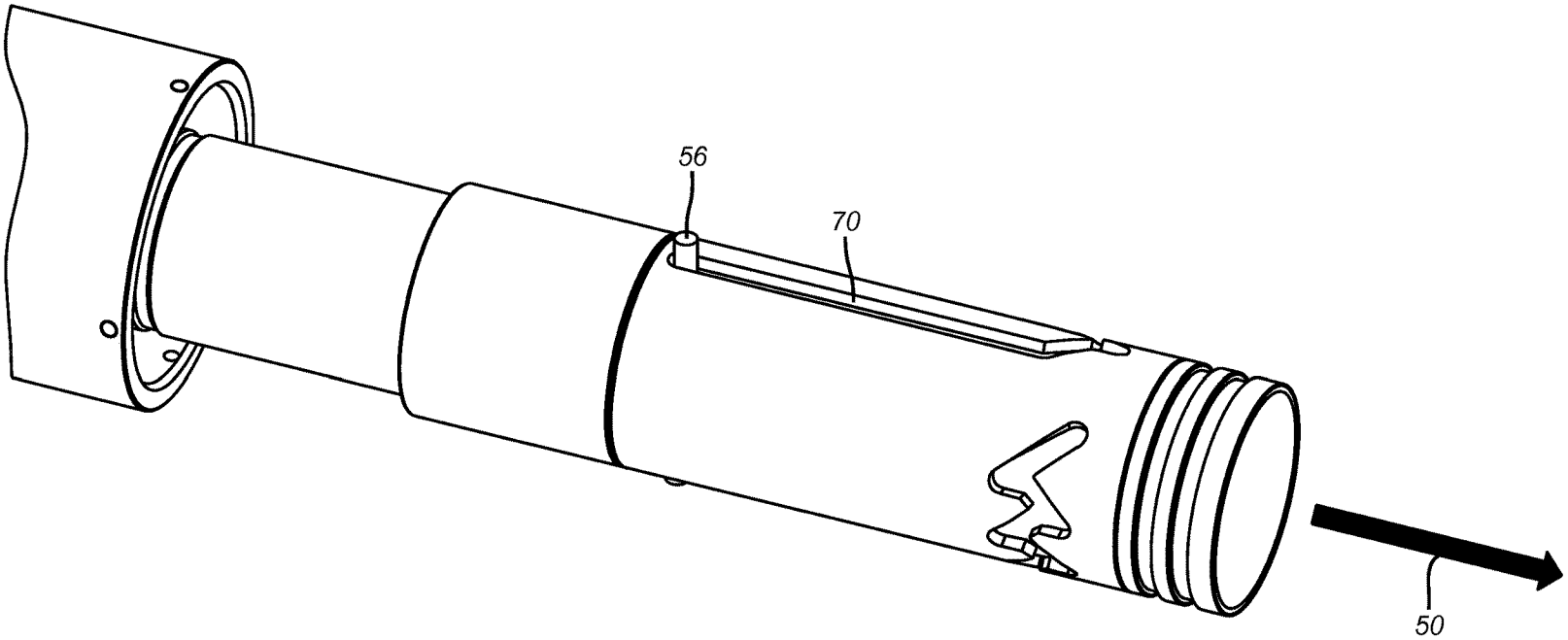
FIG. 4 is a view of sleeve movement down a long slot that allows the spring assembly to disengage from the sleeve so that the port can open.
Figure 7:
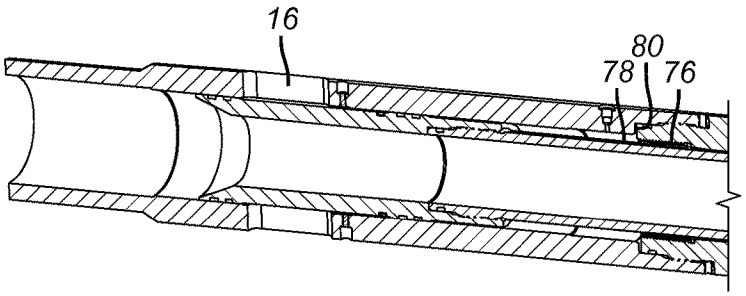
FIG. 7 shows the position of the sleeve ready to open the port but before any sleeve movement that exposes the port.
Figure 9:
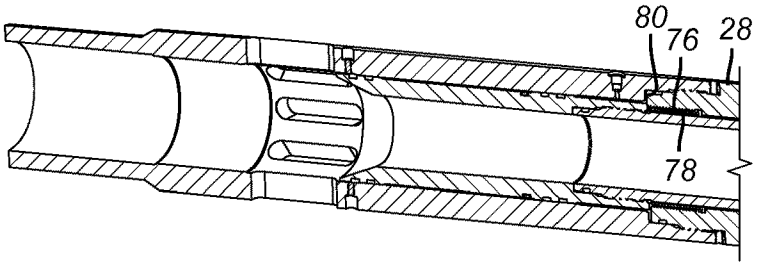
FIG. 9 shows the sleeve moving off the port and a ratchet lock engaging to hold the open port position.
Figure 10:
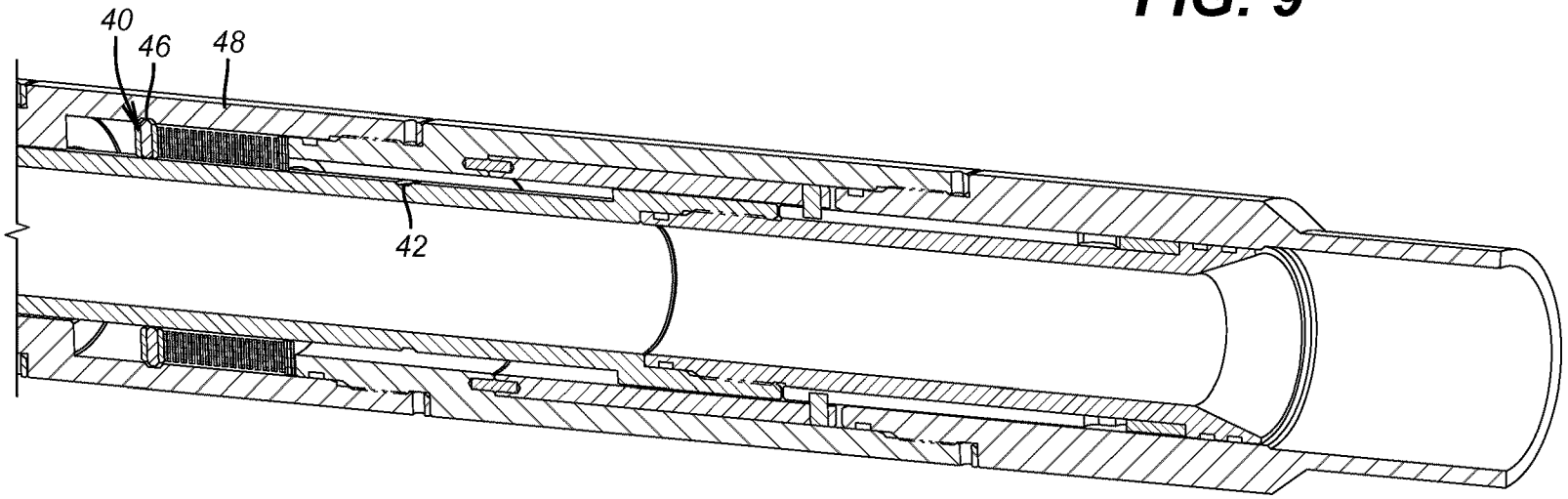
FIG. 10 shows the spring assembly retainer in a housing recess so that a bias force can no longer be applied to the released sleeve to allow the released sleeve to shift open under differential loading from applied pressure.

FIG. 4 shows what happens when pressure applied from above the sleeve assembly after a predetermined number of cycles of applying pressure and removing pressure from above allows the long slot 70 align with pin 56. As shown in FIG. 4 the slot 70 allows an added movement of the sleeve assembly 18 in the direction of arrow 50. What this does is shown in FIG. 4. During the short cycles of movement of the sleeve assembly 18 the surface 74 has kept the end ring 40 trapped in groove 42 of the sleeve assembly 18. With the long stroke the end ring 40 can move into alignment with groove 46 of housing 48 of each module 28 to allow the end rings 40 the ability to retract away from sleeve assembly grooves 42 effectively disabling the stacks 34 from any further ability to push the sleeve assembly in the uphole direction when the applied pressure from uphole is subsequently removed. However, now any pressure in the sleeve assembly will still create a net force on it in the direction of arrow 50 which will now result in opening the port or ports 16. FIG. 7 shows the sleeve assembly just before it opens to uncover ports 16. There is a fixed ratchet sleeve 76 that is still not in contact with a ratchet surface 78 on the sleeve assembly 18. When the ports 16 open, as in FIG. 9, the ratchets line up to prevent reclosing of the ports 16. The travel stop for the sleeve assembly 18 when the ports 16 open is shoulder 80 on the topmost module 28. FIG. 10 shows the lower end of the sleeve assembly 18 when ports 16 are open and how the end ring 40 has been allowed to retract from the sleeve assembly 18 to take the stacks 34 out of play as a biasing force on the sleeve assembly 18. Note how groove 42 has moved downhole with respect to groove 48 that now holds the end rings 40 in each module 28.

Figure 5:
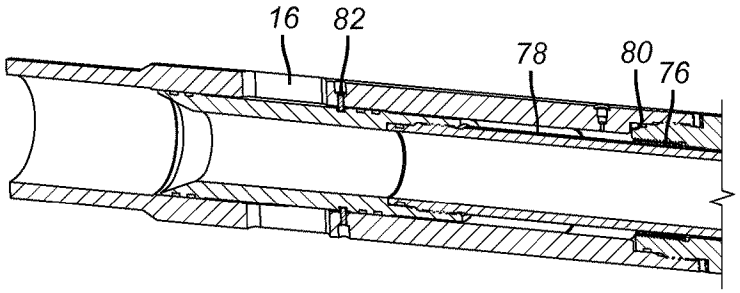
FIG. 5 is a view at the sleeve upper end during run in showing a shear pin intact and a ratchet mechanism deactivated.

FIG. 5 illustrates the shear pins 82 that hold the sleeve assembly from moving during cementing through the sleeve assembly 18 with the ports 16 closed. After the cementing is done a higher pressure than seen during cementing is applied to the sleeve assembly 18 to break the pins 82 as the pressure is further raised to the desired test pressure. After that the needed amount of pressure application and removal cycles are applied until such time as the ports 16 are open in the manner described above.

Those skilled in the art will appreciate that the preferred embodiment employs a sleeve assembly responsive to cycles of applied and removed pressure to open ports for fracturing after cementing. The net force occurs due to different piston areas at the ends of the sleeve assembly and the resisting force when the applied pressure is removed is applied by spring modules to obtain the desired force. Ultimately the spring return force is disabled to allow the sleeve assembly to move down under a net force created by differential piston areas at opposed ends. The ports open position is then locked in the ports open position.

The above description is illustrative of the preferred embodiment and many modifications may be made by those skilled in the art without departing from the invention whose scope is to be determined from the literal and equivalent scope of the claims below.

We claim:

1. An apparatus for cementing and fracturing subterranean locations in a borehole, comprising:

a housing having at least one selectively open lateral wall port;

at least one sleeve assembly selectively covering said lateral port, said sleeve assembly having an always open passage therethrough for passage of a material therethrough and into an annular space between said housing and the borehole, said sleeve assembly configured to receive a net force from pressure applied from an uphole location to said housing with said wall port closed, said sleeve assembly comprising a biased index mechanism to allow reciprocal sleeve movement for predetermined cycles of pressure application and removal while maintaining said wall port in a closed position, said sleeve assembly moving to open said port after completion of said predetermined cycles for communication to a formation through said open wall port, said biased index mechanism comprising at least one biasing device acting against a j-slot mechanism for said sleeve assembly such that movement of said j-slot mechanism allows a different movement of said sleeve assembly to open said wall port and disable said biasing device source from subsequent movement of said sleeve assembly in at least one direction.

2. The apparatus of claim 1, comprising:

said selective movement of said j-slot mechanism allows said net force alone to move said sleeve assembly away from said wall port.

3. The apparatus of claim 1, comprising:

said sleeve assembly comprising a selectively engaged lock operative to retain said sleeve assembly after said lateral wall port is opened.

4. The apparatus of claim 1, wherein:

said bias for said index mechanism comprises a housing made of modular components each modular component with a biasing assembly selectively engaged to said sleeve assembly.

5. The apparatus of claim 1, comprising:

said net force is created as a result of unequal piston areas on opposed ends of said sleeve assembly.

6. The apparatus of claim 1, comprising:

releasably retaining said sleeve assembly to said housing with said wall port closed to allow building pressure in said housing at a first predetermined pressure for a pressure test of a tubular string attached to the housing;

said lateral wall port opening with pressure lower than said first predetermined pressure applied from an uphole location to said housing with said wall port closed.

7. The apparatus of claim 1, comprising:

said index mechanism comprising a rotatably mounted sleeve on an exterior of said sleeve assembly having a slot pattern thereon and a fixed pin on said housing in registry with said slot pattern;

said slot pattern having a plurality of short apexes in opposition leading to a long slot;

said pin engaged by one of said short apexes as a travel stop for said sleeve assembly when said sleeve assembly moves responsive to said net force from pressure applied from an uphole location to said housing.

8. The apparatus of claim 7, comprising:

said short apexes are not engaged by said pin when said sleeve assembly is moved by said biasing that comprises at least one spring in said housing selectively retained to said sleeve assembly by an end ring due to said end ring first engaging a stop surface on said housing.

9. The apparatus of claim 8, comprising:

said net force acts to move said sleeve assembly in an opposite direction to said at least one spring.

10. The apparatus of claim 1, comprising:

said biasing comprises at least one spring on said housing selectively engaging said sleeve assembly;

said net force acts to move said sleeve assembly in an opposite direction to said at least one spring.

11. An apparatus for cementing and fracturing subterranean locations in a borehole, comprising:

a housing having at least one selectively open lateral wall port;

at least one sleeve assembly selectively covering said lateral port, said sleeve assembly having an always open passage therethrough for passage of a material therethrough and into an annular space between said housing and the borehole, said sleeve assembly configured to receive a net force from pressure applied from an uphole location to said housing with said wall port closed, said sleeve assembly comprising a biased index mechanism to allow reciprocal sleeve movement for predetermined cycles of pressure application and removal while maintaining said wall port in a closed position, said sleeve assembly moving clear of said port after completion of said predetermined cycles for fracturing through said open wall port;

said bias for said index mechanism comprises a housing made of modular components each modular component with a biasing assembly selectively engaged to said sleeve assembly;

said biasing assembly comprises at least one spring fixedly supported in a respective modular component at one end and having an opposed end movable in tandem with said sleeve assembly under said net force from pressure with an end ring selectively retained to said sleeve assembly.

12. The apparatus of claim 11, wherein:

said end ring is retained in a groove in said sleeve assembly by a wall on said modular component for said predetermined cycles whereupon said end ring aligns with a groove on said wall of said modular component to allow disengagement of said end ring from said sleeve assembly.

13. The apparatus of claim 11, comprising:

said at least one spring comprises a stack of Belleville washers.

* * * * *